United States Patent [19]

Brookman

[11] 4,043,164

[45] Aug. 23, 1977

[54] BRANCH TOOL

[75] Inventor: Anthony Haldane Ray Brookman, Wattle Park, Australia

[73] Assignee: Rast Patent Manufacturers Pty. Ltd., North Plympton, Australia

[21] Appl. No.: 694,478

[22] Filed: June 9, 1976

[30] Foreign Application Priority Data

June 18, 1975 Australia ..... 2025/75

[51] Int. Cl.[2] ..... B21D 19/00; B21D 39/08

[52] U.S. Cl. ..... 72/332; 72/393; 83/191

[58] Field of Search ..... 72/392, 393, 324, 332, 72/333, 335, 338, 339, 370, 464, 462; 83/180, 185, 186, 188, 191, 192, 193, 194, 195

[56] References Cited

U.S. PATENT DOCUMENTS

| | | | |
|---|---|---|---|
| 1,831,003 | 11/1931 | Holland | 29/263 |
| 2,765,848 | 10/1956 | Bakula | 83/191 |
| 3,259,003 | 7/1966 | Griffin | 83/191 X |

*Primary Examiner*—Lowell A. Larson

*Attorney, Agent, or Firm*—Oldham & Oldham Co.

[57] ABSTRACT

A tool for shaping the end of a branch tube which is to be engaged in a socket in the side of a main tube which tool comprises a die having an aperture to neatly receive the end of a branch tube to be shaped, and an intersecting bore in which a pair of cutters are disposed to each extend into the aperture, the cutters each having slits into which the end of a branch tube may be inserted, the slits being shaped to notch out diametrically opposed segments from the branch tube against the die, means being provided to displace the cutters outwardly and to return them after displacement.

5 Claims, 5 Drawing Figures

BRANCH TOOL

Figure 1:
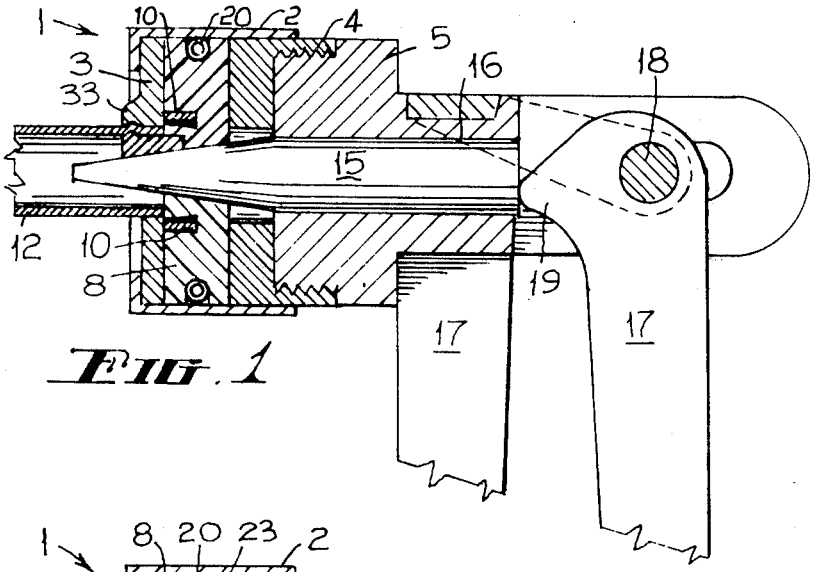

This invention relates to a branch tool.

In tube work for conveying fluids it is customary to braze or weld branches into the tubes where flow is to be divided or diverted or is to supply a number of points, and to achieve this it has been proposed heretofore to form an aperture in the wall of the tube where a branch is to be effected and to then use a tool which is inserted into the aperture and which expands the metal around the aperture into a socket into which a branch tube can then be inserted and brazed or otherwise rendered permanent.

At the same time the branch tube must have its end shaped to fit the socket to ensure that the main tube is not restricted. In the case of the socket formation, the tools have been of a relatively complicated nature because the part of the tube which does the expanding must of necessity be larger than the aperture when expansion is actually being effected, and also because of the problems of effecting expansion it has not been possible in the past to join a branch tube to a main tube line unless the branch was somewhat smaller than the main line. A co-pending invention describes an improved method of forming a socket.

According to the specification of U.S. Application Ser. No. 610,125 an expansion tool comprises a member having jaws which are forced apart by a tapered drift after inserting the jaws into the end of a tube to thereby expand such tube.

The present invention comprises a head which can either be applied to the tool of that earlier device or it can be formed as a complete tool, According to this invention a head is provided which can shape the end of a branch tube to neatly fit a socket formed in the main line and this is achieved by using what we will term a die which has in it preferably axially disposed an aperture into which the end of a branch tube can be inserted to be engaged by cutters disposed within the die, and which are radially movable in sockets in the die, and the inner faces of these cutters are shaped to engage a drift which when forced in between the cutters will cause the cutters to shape the end of the tube.

Such a head can as said be an attachment to the type of expansion tools referred to, and the drift of the expansion tool can be the member which moves the cutters outwardly to effect the shaping of the end of the branch tube, but of course means other than a taper drift can be used to move the cutters outwardly, or a special tool with a drift to move the cutters could be utilized to apply the pressure to the cutters to effect the shaping of the end of the branch tube.

In its preferred form the head for shaping the end of a branch tube which is to be engaged in a socket in the side of a main tube, comprises a die having an aperture to neatly receive the end of a branch tube to be shaped, a bore in the die intersecting the aperture, a pair of cutters being disposed within the bore in the die and meeting in the aperture, the cutters having slits in each which face the opening of the aperture in the die into which the branch tube is inserted, the slits being shaped to engage the branch tube to notch out two diametrically opposed segments from the branch tube against the die, there being means to displace the cutters outwardly and means to return the cutters after displacement.

Figure 2:
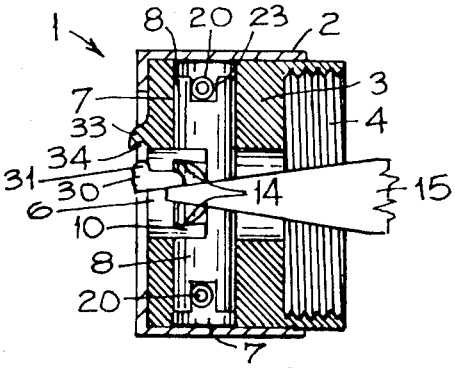
Figure 4:
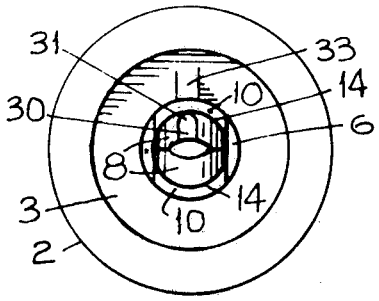
Figure 3:
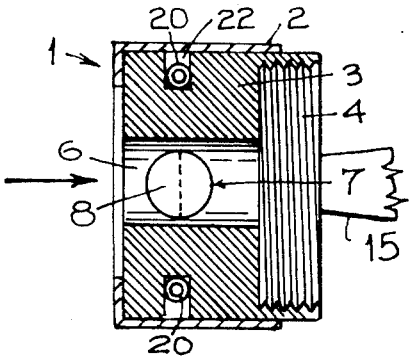
Figure 5:
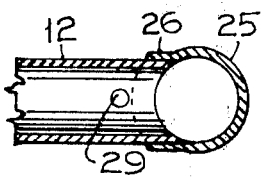

In order however that the invention may be more clearly understood, an embodiment thereof will now be described with reference to the accompanying drawings in which:

FIG. 1 is a transverse section of a tool according to this invention, with the cutters in a position where the end of a tube has just been shaped, and showing the cut segment in place in the slits of the cutters, FIG. 2 is a transverse section of a head but showing the cutters unsectioned and in a position where the die is ready to receive a tube to be shaped, FIG. 3 is a central sectional view of the head but turned through a right angle, FIG. 4 is an end elevation, and FIG. 5 shows a branch tube with a shaped end inserted in a socket formed on the side of a main tube.

The head 1 comprises an outer sleeve 2 and a die 3, the die 3 being cylindrical and provided with a screw thread 4 whereby it can be attached to the body 5 of an operating device.

The die 3 has a central axial aperture 6 through it of a dimension such that a tube which is to have its end shaped can fit neatly into this aperture.

Intersecting the aperture 6 is a bore 7 which is diametrically arranged in the die and has in it a pair of cutters 8 which are of circular cross-section and which are of a length such that their inner ends project into the central aperture 6 of the die 3 a distance sufficient to allow slits 10 in the said cutters to accommodate the end of a branch tube 12 a sufficient distance so that when the cutters 8 are moved outwardly, the inner edges 14 of the cutters 8 which define the edge of the slits 10 form a cutting face in conjunction with the wall of the aperture 6 so that the end of the branch tube is sheared by these co-operating faces to notch it diametrically oppositely in the correct manner to neatly fit the main tube to which the branch tube 12 is to be attached.

The cutters 8 are moved outwardly by a tapered drift 15 axially slidable in a bore 16 in the body 5, the body having on it a pair of handles 17 one of which is carried thereon by a pivot pin 18 and has a cam 19 which engages the end of the drift 15 to move it forward from the position shown in FIG. 2 to the position shown in FIG. 1 when the end of the branch tube is to be shaped.

In operation as the drift 15 is moved forward it exerts pressure against the inner end of the cutters 8 and the edges 14 of the cutters effect the actual shearing of the metal against the edges of the bores 7 of the die 3 as the cutters 8 are urged outwardly by the drift 15.

The slits formed in the cutters 8 are arcuate as shown in FIG. 4 to give a cutting edge which generally follows the inner contour of the main tube to which the branch is to be joined.

The cutters 8 are urged inwardly, and prevented from rotating by a spring circlip 20 fitted in a groove 22 around the perimeter of the die 3 and engaging slits 23 in the outer ends of the cutters 8.

The branch tube 12 is positioned into the central aperture 6 of the die 3 to project into the slits 10 of the cutters 9 a sufficient distance that all required parts of the end of the branch tube which require to be sheared are in a position to be engaged by the cutters 8 when the cutters are moved outwardly.

It is desirable to shape the cut being made at the end of the branch tube 12 to follow the contour of the inside of the tube 25 (see FIG. 5) to which it is to be joined, and therefore the cutters 8 are dimensioned to effect a cut which will follow the inner wall of the tube 25. The aperture 6 at the centre of the die 3 will have a dimension such that it neatly takes the end of the branch tube 12 but the diameter of the cutters will be selected to suit the inner diameter of the main tube 25 to which the branch tube 12 is to be joined, the distance the branch tube is inserted into the cutters 8 depending on the ratio of the diameters of the two tubes.

In this way the end of the branch tube will be cut out to the diameter of the main tube, and when such a branch tube is then inserted in the socket 26, the contour of the end of the branch tube will follow the main tube interior surface to make a neat join without any obstruction being formed as shown in FIG. 5.

The mechanism for urging the cutters into their cutting action and of returning the cutters can of course be varied within the spirit of the invention and, as stated earlier, while the device can conveniently be used with a branch tool having a drift as the means to actuate the mechanism of the head, it can be an independent tool but as a general rule it is preferred to make it part of a branch tool assembly such as is shown in the Patent specification earlier referred to herein, and which is adapted for use for expanding the ends of tubes by having expanding jaws actuated by a drift.

An indexing protrusion 29 can be given to the branch by having a member fixed to the cutters 8 actuated by the drift to press out a dimple or ridge in the branch to limit insertion of the branch in the socket, at least one of the cutters 8 thus having an extension 30 removably engaged in it which has a dimple 31 on it. The die 3 may have a complementary extension 33 on it with a depression 34 to receive the metal depressed by the dimple 31.

The sleeve 2 may be slid off the die 3 to allow the cutters to be inserted into the bore 7, and similarly when it is desirable to remove the cutters or replace them with differently shaped cutter slits, removal is possible by withdrawing the sleeve 2 and removing the spring circlip 20. To remove the die 8 which carries the extension 30, the extension is withdrawable.

The slits 10 can have a narrow central opening extended right through the cutters to allow the cut segments to be ejected from the rear of the cutters if the segments do not fall out.

I claim:

1. A tool for shaping the end of a branch tube which is to be engaged in a socket in the side of a main tube, comprises a die having an aperture to neatly receive the end of a branch tube to be shaped and encircle the end of the said tube when inserted into the die, and a bore in the die intersecting the said aperture, a pair of cutters disposed within the said bore in the said die on diametrically opposed sides thereof and extending into the said aperture, slits in each cutter which face the opening of the said aperture in the said die into which the branch tube may be inserted, the slits having their outer walls co-extensive with the walls of the said aperture and being shaped to engage the end of the branch tube to notch out diametrically opposed segments from the branch tube against the said die when the said cutters are outwardly displaced, means to displace the said cutters outwardly, and means to return the said cutters after displacement.

2. A tool according to claim 1 for shaping the end of a branch tube wherein at least one of said cutters has an extension with a dimple thereon positioned to form an indexing protrusion on said branch tube when the said cutters are moved outwardly to shape the end of said branch tube.

3. A tool according to claim 2 wherein the said die has a depression outside of the plane of the said aperture in the said die, which depression coincides with the said dimple to shape the indexing protrusion.

4. A tool for shaping the end of a branch tube which is to be engaged in a socket in the side of a main tube, comprises a die having an aperture to neatly receive and encircle the end of a branch tube to be shaped, a bore in the die intersecting the said aperture, a pair of cutters disposed within the said bore in the said die and extending into the said aperture, slits in each cutter which face the opening of the said aperture in the said die into which the branch tube may be inserted, said slits having their outer walls co-extensive with the wall of the said aperture and being shaped to engage the end of the branch tube to notch out diametrically opposed segments from the branch tube against the said die, a tapered drift engaged between the said cutters and axially movable in the said aperture, a body engaging the said die and slidably supported in it the said tapered drift, said body being provided with handles one fixed to the body and the other pivoted thereon, the said pivoted handle having a cam thereon engaging the said drift, a spring circlip in a groove around said die engaging in slits in the outer ends of said cutters whereby to urge the said cutters inwards and prevent rotation of the said cutters in the said bore, and a sleeve around the said die to confine the said cutters in the said die.

5. A head for a tool for shaping the end of a branch tube which is to be engaged in a socket in the side of a main tube, and which is adapted to be engaged on a branch tool, comprises a die having an aperture to neatly receive the end of a branch tube to be shaped and encircling the end of the said tube when inserted into the die, and a bore in the die intersecting the said aperture, a pair of cylindrical cutters disposed within the said bore in the said die and meeting in the aperture, slits in each cutter which face the opening of the said aperture in the said die into which the branch tube is inserted, the slits having their outer walls co-extensive with the walls of the said aperture and being shaped to engage the end of the branch tube to notch out diametrically opposed arcuate segments from the branch tube against the said die when said cutters are outwardly displaced, said cutters being adapted to be engaged by means which displace the said cutters outwardly when the head is connected to the said branch tool, and spring means to return the said cutters after displacement.

* * * * *

UNITED STATES PATENT OFFICE
CERTIFICATE OF CORRECTION

PATENT NO. 4,043,164

DATED : August 23, 1977

INVENTOR(S) : Anthony Haldane Ray Brookman

It is certified that error appears in the above-identified patent and that said Letters Patent are hereby corrected as shown below:

Column 1, line 28, change "Serial No. 610,125" to --Serial No. 610,176--.

Signed and Sealed this

*Twenty-fourth* Day of *January 1978*

[SEAL]

*Attest:*

RUTH C. MASON
*Attesting Officer*

LUTRELLE F. PARKER
*Acting Commissioner of Patents and Trademarks*